US006899024B2

(12) United States Patent
Watanabe et al.

(10) Patent No.: US 6,899,024 B2
(45) Date of Patent: May 31, 2005

(54) STENCIL PRINTING METHOD AND APPARATUS INCLUDING PRINTING DRUM WITH DATA STORAGE SECTION FOR STORING PRINTING AND STENCIL MAKING CONDITIONS

(75) Inventors: Hidetoshi Watanabe, Ibaraki-ken (JP); Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/773,280

(22) Filed: Feb. 9, 2004

(65) Prior Publication Data

US 2004/0154483 A1 Aug. 12, 2004

(30) Foreign Application Priority Data

Feb. 10, 2003 (JP) ..... P2003-032365

(51) Int. Cl.[7] ..... B41L 13/04; B41C 1/14

(52) U.S. Cl. ..... 101/128.4; 101/116; 101/484

(58) Field of Search ..... 101/114, 116, 101/117, 118, 119, 120, 129, 128.4, 483, 484

(56) References Cited

U.S. PATENT DOCUMENTS 5,323,704 A * 6/1994 Fraczek ..... 101/375
5,537,920 A * 7/1996 Hasegawa et al. ..... 101/116
6,123,024 A * 9/2000 Williams et al. ..... 101/129
6,578,477 B2 * 6/2003 Yanagi et al. ..... 101/116
6,748,856 B2 * 6/2004 Witte ..... 101/129

FOREIGN PATENT DOCUMENTS

JP 06-155882 6/1994

* cited by examiner

*Primary Examiner*—Leslie J. Evanisko
(74) *Attorney, Agent, or Firm*—Nath & Associates PLLC; Gary M. Nath; Derek Richmond

(57) ABSTRACT

A machine for stencil printing includes: a control panel for setting stencil making conditions and printing conditions; a stencil making section making a stencil sheet based on the stencil making conditions; a stencil winding section wrapping the perforated stencil sheet around a printing drum, the printing drum comprising a storage section; a printing section including a printing conditions adjustment section, the printing conditions adjustment section adjusting the printing section based on the printing conditions; and a control section storing the stencil making conditions of the stencil sheet and the printing conditions into the storage section at the time when the perforated stencil sheet is wrapped around the printing drum, the control section adjusting the printing condition adjustment section to print based on the stencil making conditions and the printing conditions in response to a direction of start of the printing processing.

10 Claims, 7 Drawing Sheets

STENCIL PRINTING METHOD AND APPARATUS INCLUDING PRINTING DRUM WITH DATA STORAGE SECTION FOR STORING PRINTING AND STENCIL MAKING CONDITIONS

BACKGROUND OF THE INVENTION

1. Field of the Invention

The present invention pertains to a stencil printing machine and a printing method for the same, which performs stencil making processing and printing processing according to printing conditions, such as ink-saving printing or the like.

2. Description of the Related Art

In a stencil printing machine, which prints by pressing a printing paper against a perforated stencil sheet wrapped around a printing drum with a pressure roller, the stencil printing machine, which is possible to print under desired printing density by setting printing conditions, such as a pressure force (printing pressure force) or printing speed, is proposed by the present applicant in Japanese Patent Laid Publication No. 2593623.

According to the methodology disclosed in above publication, for example, the low cost printing to cut back ink consumption, ink-saving printing in consideration of the ecology for environment, etc. is achieved by setting the printing conditions so as thin printing density.

In the conventional stencil printing machine, however, the ink-saving printing was achieved by adjusting printing conditions suitably, such as a pressure force and/or printing speed, by a user, in order to adjust the printing density. Therefore, in the case that the stencil making processing and the printing processing are performed separately, or in the case that two or more printing drums are exchanged one after another for the multi-color printing, the user needed to memorize the printing conditions corresponding to the perforated stencil sheet wrapped around the printing drum to be used for the printing processing, and needed to setting the printing condition, such as the pressure force and/or printing speed, based on the user's memory, whenever the printing processing is performed. Thus, it was troublesome for the user that the printing conditions must be set up whenever the printing processing is performed, therefore, it was the problem that the setting mistake by setting up based on the user's memory occurred and the efficiency of printing is reduced.

Further, in recent years, corresponding to various requests from the user, the stencil printing machine is enabling selection of various printings, such as the "ink-savingprinting", "high quality printing", or the like, other than standard printing.

Such various printings are achieved by setting the stencil making conditions and the printing conditions as a predetermined relation. Therefore, it is a very difficult situation to set the stencil making conditions and the printing conditions corresponding to the perforated stencil sheet wrapped around the printing drum to be used for the printing processing based on only the user's memory whenever the printing processing is performed.

SUMMARY OF THE INVENTION

A machine for stencil printing according to an embodiment of the present invention includes: a control panel for setting stencil making conditions and printing conditions; a stencil making section making a stencil sheet based on the stencil making conditions; a stencil winding section wrapping the perforated stencil sheet around a printing drum, the printing drum comprising a storage section; a printing section including a printing conditions adjustment section, the printing conditions adjustment section adjusting the printing section based on the printing conditions; and a control section storing the stencil making conditions of the stencil sheet and the printing conditions into the storage section at the time when the perforated stencil sheet is wrapped around the printing drum, the control section adjusting the printing condition adjustment section to print based on the stencil making conditions and the printing conditions in response to a direction of start of printing processing.

Further, a method for stencil printing of a stencil printing machine, which includes a control panel for setting stencil making conditions and printing conditions, a stencil making section making a stencil sheet based on the stencil making conditions, a stencil winding section wrapping the perforated stencil sheet around a printing drum, a printing section printing having a printing condition adjustment section adjusting the printing section based on the printing conditions, according to an embodiment of the present invention includes: storing the stencil making conditions of the stencil sheet and the printing conditions into a storage section installed in the printing drum at the time when the perforated stencil sheet is wrapped around the printing drum; and adjusting the printing condition adjustment section to print based on the stencil making conditions and the printing conditions in response to a direction of start of printing processing.

DETAILED DESCRIPTION

Figure 1:
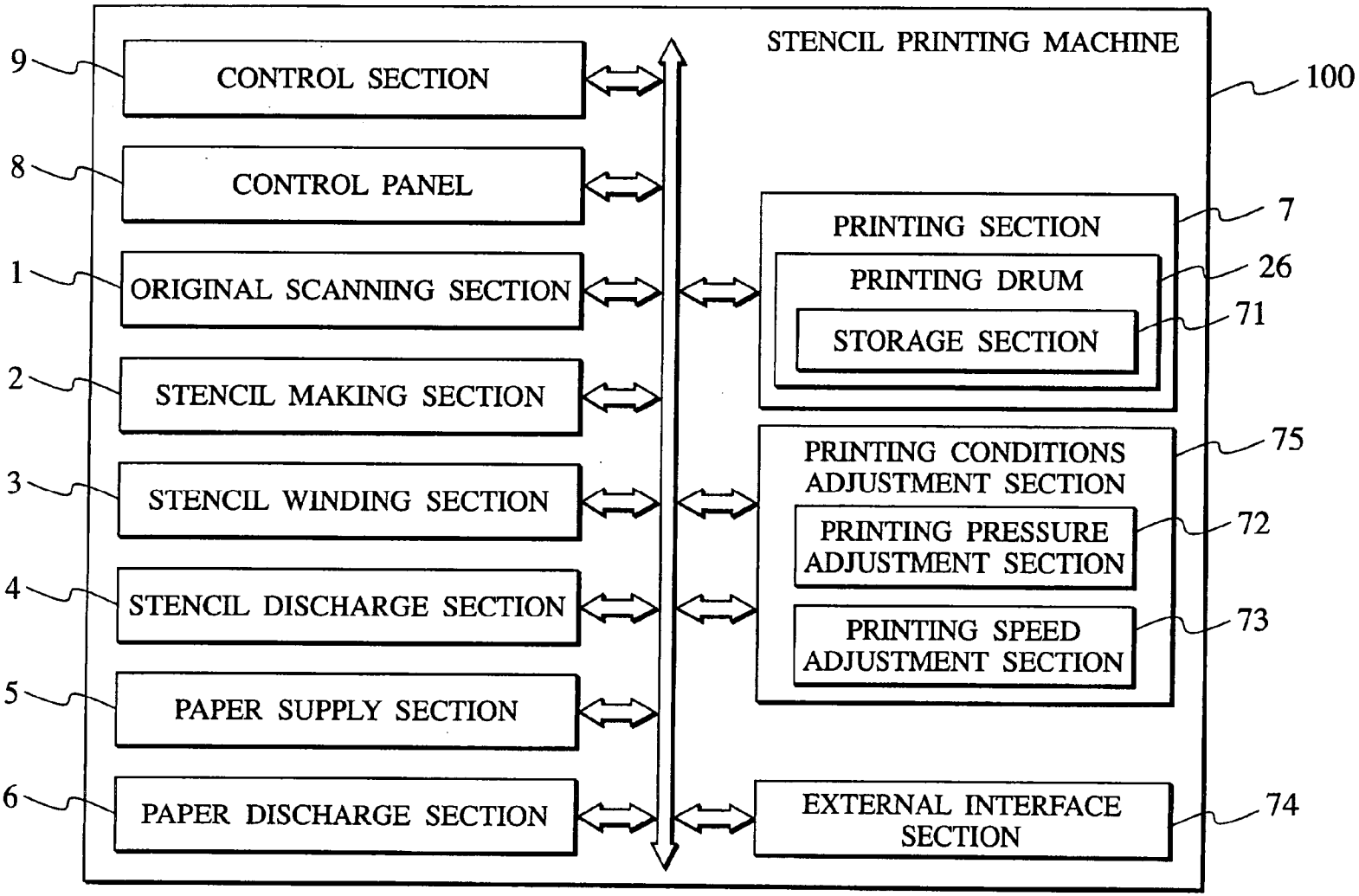
FIG. 1 is a block diagram showing an example of structure of a stencil printing machine according to an embodiment of the present invention.

The present embodiment aims to disclose a stencil printing machine and a method for the stencil printing machine, which performs stencil making and printing based on printing mode and printing conditions corresponding to a perforated stencil sheet wrapped around a printing drum to be used for printing processing, even if the stencil making processing and the printing processing are performed separately, or even if two or more printing drums are exchanged one after another to perform multi-color printing.

A machine for stencil printing according to the present embodiment includes: a control panel for setting stencil making conditions and printing conditions; a stencil making section making a stencil sheet based on the stencil making conditions; a stencil winding section wrapping the perforated stencil sheet around a printing drum, the printing drum comprising a storage section; a printing section including a printing conditions adjustment section, the printing conditions adjustment section adjusting the printing section based on the printing conditions; and a control section storing the stencil making conditions of the stencil sheet and the printing conditions into the storage section at the time when the perforated stencil sheet is wrapped around the printing drum, the control section adjusting the printing condition adjustment section to print based on the stencil making conditions and the printing conditions in response to a direction of start of printing processing.

Further, a method for stencil printing of a stencil printing machine, which includes a control panel for setting stencil making conditions and printing conditions, a stencil making section making a stencil sheet based on the stencil making conditions, a stencil winding section wrapping the perforated stencil sheet around a printing drum, a printing section printing having a printing condition adjustment section adjusting the printing section based on the printing conditions, according to the present embodiment includes: storing the stencil making conditions of the stencil sheet and the printing conditions into a storage section installed in the printing drum at the time when the perforated stencil sheet is wrapped around the printing drum; and adjusting the printing condition adjustment section to print based on the stencil making conditions and the printing conditions in response to a direction of start of printing processing.

In addition, "stencil making conditions" set up by a user corresponds to "printing mode", and the "stencil making conditions" includes "ink-saving printing" in order to cut back ink consumption, "high quality printing" for high-definition printing, and "standard printing", etc. Further, "printing conditions" includes "printing speed" and "printing density" corresponding to the "printing mode" set up by the user, and the "printing conditions" are adjusted by a printing conditions adjustment section. The printing conditions adjustment section includes a printing speed adjustment section for adjusting printing speed as number of revolutions of the printing drum and a printing pressure adjustment section for adjusting printing density as a pressure force of a pressure roller against the printing drum.

According to the above composition, at the time when the printing mode such as the ink-saving printing, the high quality printing, the standard printing or the like, and the printing condition such as the printing speed, the printing density or the like are inputted and the direction of the stencil making start is inputted via the control panel by a user, the stencil making section makes a stencil sheet based on the printing mode (stencil making conditions). At the time when the stencil winding section wraps the perforated stencil sheet around the printing drum, the printing mode (stencil making conditions) and the printing conditions are stored in the storage section installed in the printing drum on which the perforated stencil sheet is wrapped.

The control section adjusts the printing condition adjustment section to print based on the printing mode (stencil making conditions) and the printing conditions in response to a direction of start of printing processing by the user.

Further, at the time when the printing drum to be used for printing processing is set on the stencil printing machine, the control section may adjust the printing condition adjustment section to print based on the printing mode (stencil making conditions) and the printing conditions stored in the storage section of this printing drum.

According to the above composition, even if the stencil making processing and the printing processing are performed separately, or even if two or more printing drums are exchanged one after another for the multi-color printing, it is possible to print based on the printing mode (stencil making conditions) and the printing conditions corresponding to the perforated stencil sheet wrapped around the printing drum to be used for the printing processing.

Furthermore, the stencil printing machine has a display sections (a liquid crystal touch panel, the printing density display section and the printing speed display section), and displays the printing mode and the printing conditions stored in the storage section of the printing drum to be used for the printing processing, the user is able to recognize the printing conditions corresponding to the perforated stencil sheet wrapped around the printing drum to be used in the printing processing.

Various embodiments of the present invention will be described herein below with reference to the accompanying FIGS. 1 through 6. It is to be noted that the same or similar reference numerals are applied to the same or similar parts and elements throughout the drawings, and the description of the same or similar parts and elements will be omitted or simplified.

Components of Stencil Printing Machine

As shown in FIG. 1, a stencil printing machine 100 includes a control section 9, a control panel 8, an original scanning section 1, a stencil making section 2, a stencil winding section 3, a stencil discharge section 4, a paper supply section 5, a paper discharge section 6, a printing section 7, a printing conditions adjustment section 75, and an external interface section 74.

Although not shown, the control section 9 includes a Central Processing Unit (CPU), a Random Access Memory (RAM), a Read Only Memory (ROM), and a storage unit (for example, a hard disk drive), or the like. The CPU reads out programs and data stored in the ROM and/or the storage unit to the RAM, processes them, and controls all sections of the stencil printing machine 100 based on processing results.

The external interface section 74 includes function for the stencil printing machine 100 connecting with other apparatuses across a network etc.

Figure 4:
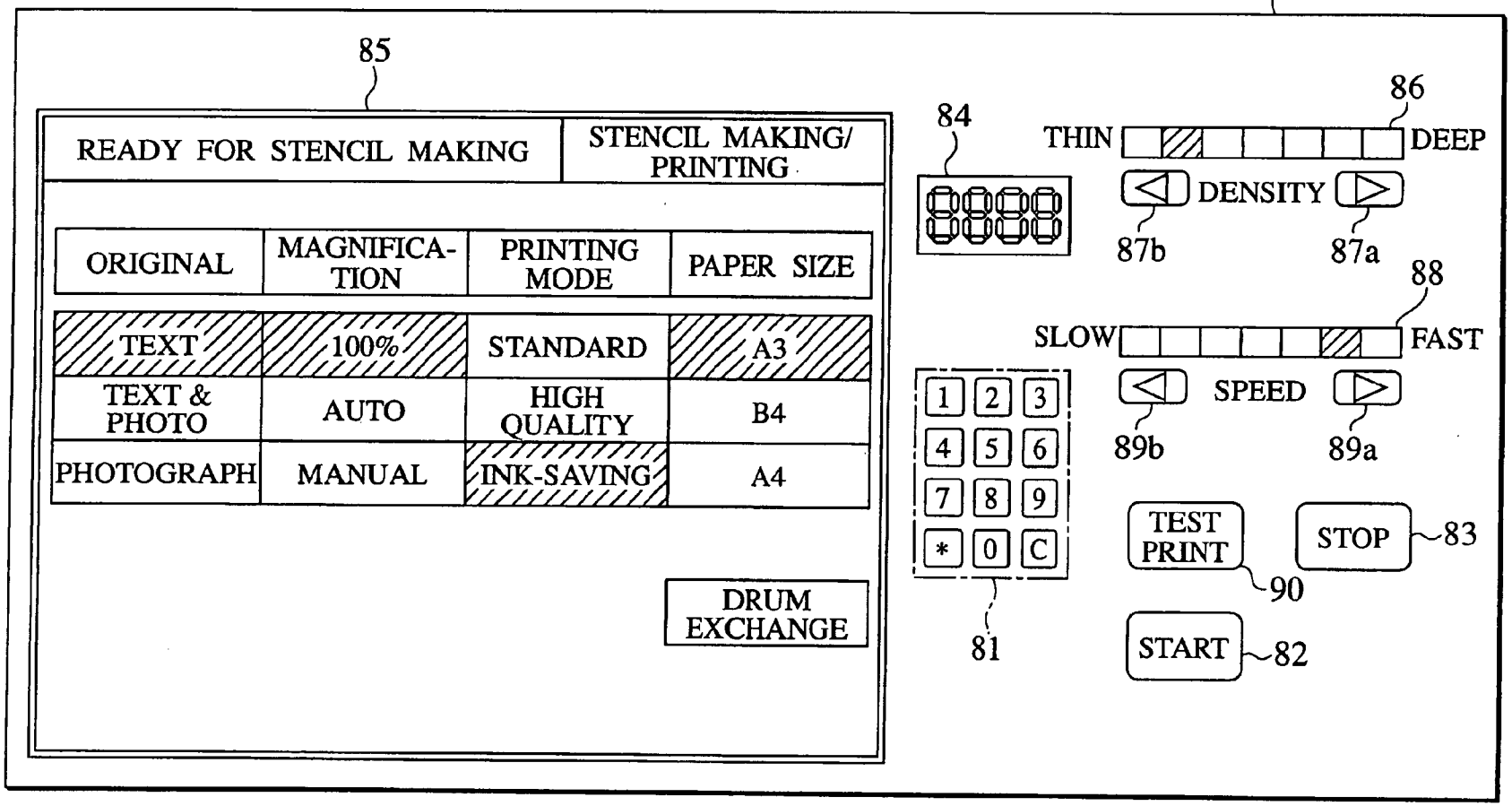
FIG. 4 is a scheme diagram showing an example of a control panel in the stencil printing machine shown in FIG. 1.

The control panel 8 is located on the upper part of the stencil printing machine 100 in order to implement an interface with a user, and has a liquid crystal touch panel 85, a ten-keypad 81, a start key 82, a stop key 83, a display section 84, and the like, as shown in FIG. 4. The liquid crystal touch panel 85 is a touch panel for setting the type of the original, printing mode (stencil making conditions), or the like by the user and displaying information to the user. The ten-keypad 81 is a keypad for inputting the number of prints or the like. The start key 82 is a key for starting a stencil making processing or printing processing. The stop key 83 is a key for stopping the stencil making processing or printing processing. The display section 84 displays the set-up number of the prints or the like.

Further, the control panel 8 has printing density setting keys 87*a* and 87*b* for setting printing density, a printing density display section 86 for displaying the printing density, printing speed setting keys 89*a* and 89*b* for setting printing speed, a printing speed display section 88 for displaying the printing speed, a test print key 90 for starting a test print processing, and the like.

When performing the stencil making processing or printing processing, the "stencil making" or "printing" processing will be set up in turn at the touch of a "STENCIL MAKING/PRINTING" button displayed on the upper right corner of the liquid crystal touch panel 85. For example, if the "stencil making" processing is set up, a stencil making setting screen is displayed on the liquid crystal touch panel 85, as shown in FIG. 4. Desired stencil making conditions is set up at the touch (operation) of various selection buttons, such as "ORIGINAL" (type of the original), "MAGNIFICATION", "PRINTING MODE", and "PAPER SIZE" displayed on the stencil making setting screen, and then the stencil making processing will be started if the start key 82 is operated (touched). After the stencil making processing is completed, "READY FOR PRINTING" is displayed on the display button displayed on the upper left corner of the liquid crystal touch panel 85.

Figure 5:
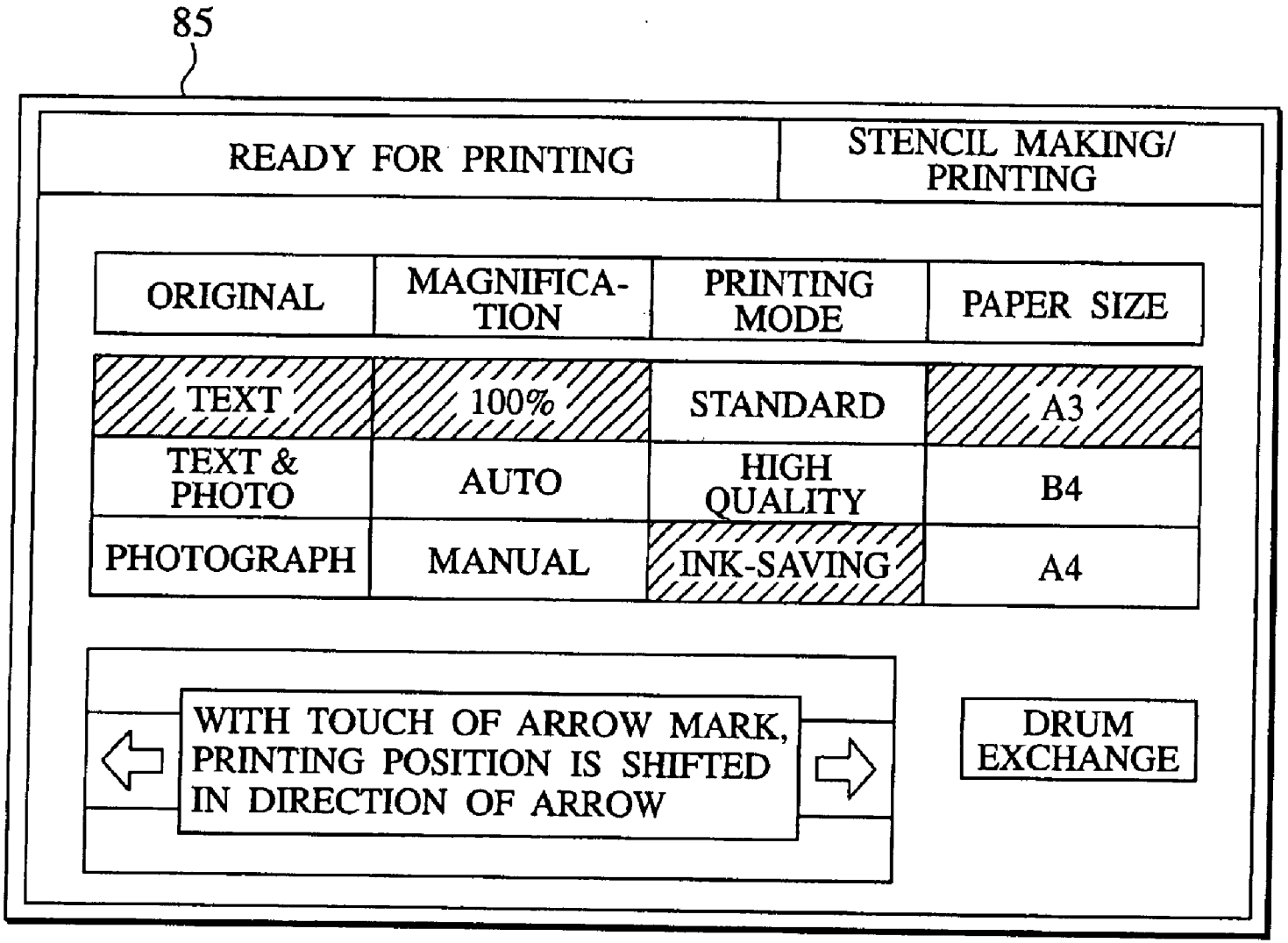
FIG. 5 is a scheme diagram showing an example of a screen of a display section of the control panel shown in FIG. 4.

Further, if the "printing" processing is set up at touch of the "STENCIL MAKING/PRINTING" button, a printing setting screen as an example shown in FIG. 5 will be displayed on the liquid crystal touch panel 85. Then, desired printing conditions are set up on the printing setting screen if needed, and then the printing processing will be started if the start key 82 is operated (touched). More specifically, if the "PRINTING MODE" is set as "INK-SAVING", setting standard value of the printing density and the printing speed according to the ink-saving printing, which have been previously set up and stored in the ROM or the like of the control section 9, will be automatically displayed on the printing density display section 86 and the printing speed display section 88. Moreover, the user can also manually operate the printing density setting keys 87*a* and 87*b* and/or the printing speed setting keys 89*a* and 89*b* in order to change the setting value.

Returning to the block diagram of FIG. 1, a printing drum 26 of the printing section 7 has a storage section 71. The control section 9 stores the printing mode (stencil making conditions) and the printing conditions set up by the user into the storage section 71 at the time when a perforated stencil sheet 18 is wrapped around the outer surface of the printing drum 26 by the stencil winding section 3. Then, if the start of the printing processing is directed, the control section 9 reads the printing mode and the printing conditions stored in the storage section 71 and controls a printing condition adjustment section 75 based on the read printing conditions, and then the printing section 7 executes the printing processing based on the printing conditions.

The printing condition adjustment section 75 includes a printing pressure adjustment section 72 for adjusting the printing density and a printing speed adjustment section 73 for adjusting the printing speed. More specifically, the printing density is adjusted such that the pressure of a pressure roller 140 against the printing drum 26 controlled by the printing pressure adjustment section 72 is adjusted to the pressure force corresponding to the printing density set up by the user. Further, the printing speed is adjusted such that the rotation speed of the printing drum 26 driven by a drum driving motor 25 controlled by the printing speed adjustment section 73 is adjusted to the printing speed (printing speed corresponding to the printing mode) set up by the user. In addition, the conversion value from the printing density to the pressure force, and the conversion value from the printing speed to the rotation speed of the printing drum 26 are previously stored in the ROM or the like of the control section 9.

Figure 2:
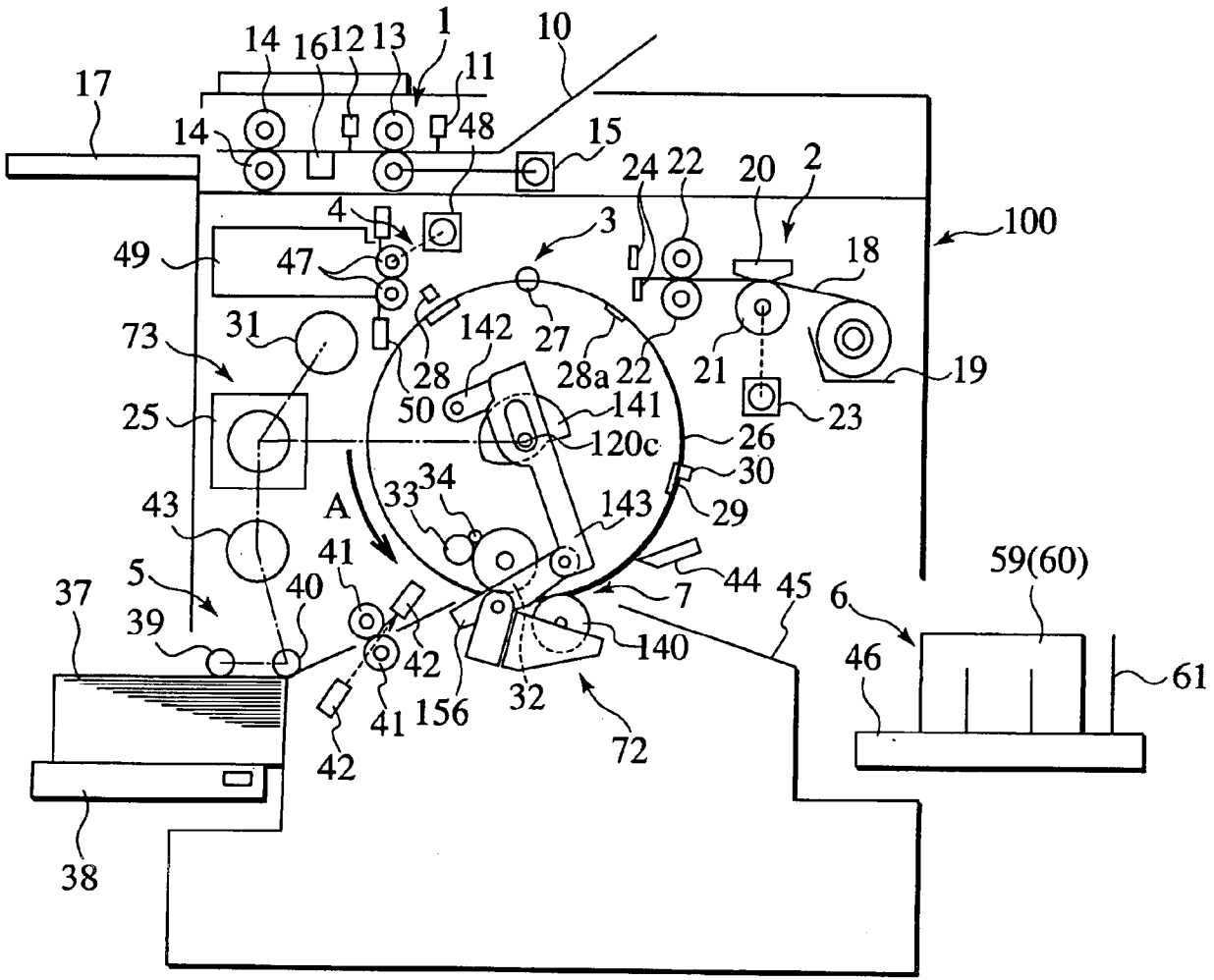
FIG. 2 is a scheme diagram showing an example of structure of a stencil making section and a printing section in the stencil printing machine shown in FIG. 1.

As shown in FIG. 2, the original scanning section 1 includes an original set tray 10, reflected-type original detection sensors 11 and 12, original feed rollers 13 and 14, a stepping motor 15, a contact-type image sensor 16, and an original discharge tray 17. An original, which is to be printed, is set on the original set tray 10. The original detection sensors 11 and 12 detect the presence or absence of the original sat on the original set tray 10. The original feed rollers 13 and 14 are rotationally driven by the stepping motor 15 and thus transfer the original sat on the original set tray 10. The image sensor 16 optically scans the image data of the original transferred by the original feed rollers 13 and 14, and changes the scanned image data into an electric signal. The original discharge tray 17 stacks the original transferred from the original set tray 10. Thus, the original stacked on the original set tray 10 is transferred by the original feed rollers 13 and 14, and the transferred original is scanned by the image sensor 16.

The stencil making section 2 includes a stencil sheet roll container 19 for containing the stencil roll sheet 18, a thermal print head 20 located downstream from the stencil sheet roll container 19, a platen roller 21 opposed to the thermal print head 20, a pair of stencil sheet feed rollers 22 located downstream from the thermal print head 20 and the platen roller 21, a write pulse motor 23 for driving the rotation of the platen roller 21 and the pair of stencil sheet feed rollers 22, and a cutter 24 located downstream from the pair of stencil sheet feed rollers 22. The stencil roll sheet 18 is transferred by rotation of the platen roller 21 and the pair of stencil sheet feed rollers 22. Then, each of heat elements of the thermal print head 20 perforates the transferred stencil roll sheet 18 selectively in order to make a stencil based on the image data scanned by the image sensor 16, and the cutter 24 cuts the perforated stencil sheet 18 to a predetermined length.

The stencil winding section 3 includes a clamp section 27, a stencil sheet sensor 28, and the like. The clamp section 27 is located on the outer peripheral surface of the printing drum 26, and clamps the leading end of the perforated stencil sheet 18. The stencil sheet sensor 28 detects whether the perforated stencil sheet 18 is wrapped around the outer peripheral surface of the printing drum 26 by referencing a detection chip 28*a* of the printing drum 26.

The printing section 7 includes the printing drum 26, a fiducial position detection sensor 30, and a rotary encoder 31. The printing drum 26 is composed of ink permeable elements at its outer peripheral surface using a porous structure, and rotated in the direction of arrow A of FIG. 2 by the drive force of the drum driving motor 25. The fiducial position detection sensor 30 detects the fiducial position of the printing drum 26 by referencing a detection chip 29 of the printing drum 26. The rotary encoder 31 detects rotation of the drum driving motor 25. The rotation position of the printing drum 26 can be detected by referencing the output pulse of the rotary encoder 31 based on the detection output of the fiducial position detection sensor 30. In addition, the drum driving motor 25 is controlled by the printing speed adjustment section 73.

Further, the printing section 7 has a squeegee roller 32 located on the inner surface of the printing drum 26, and a doctor roller 33 located on close to the squeegee roller 32. Ink 34 is accumulated in the outer peripheral space surrounded with the squeegee roller 32 and the doctor roller 33. Since the ink 34 adhering to the periphery of the rotating squeegee roller 32 passes along the crevice between the doctor rolls 33 and the squeegee roller 32, only the ink 34 of the predetermined thin film adheres to the squeegee roller 32, and the ink 34 of the predetermined thin film is supplied to the inner surface of the printing drum 26.

Furthermore, a pressure roller 140 for pressing a printing paper 37 against the printing drum 26 is driven by the printing pressure adjustment section 72, synchronizing with the rotation of the printing drum 26.

The clamp section 27 clamps the leading end of the perforated stencil sheet 18 fed from the stencil making section 2. After being clamped, the perforated stencil sheet 18 is wrapped around the outer surface of the printing drum 26 by rotating the printing drum 26. Since the pressure roller 140 presses the printing paper 37 fed from the paper supply section 5 toward to the perforated stencil sheet 18 synchronizing with the rotation of the printing drum 26, the ink 34 is transferred to the printing paper 37 through the perforation of the perforated stencil sheet 18, and the image of the original is printed on the printing paper 37.

The paper supply section 5 includes a paper feed tray 38 on which the printing paper 37 are stacked, paper feed rollers 39 and 40, a pair of timing rollers 41, and a paper detection sensor 42. The paper feed rollers 39 and 40 transfer the printing paper 37 one by one from the top of the printing paper 37 stacked on the paper feed tray 38. The pair of timing rollers 41 transfer the printing paper 37 fed by the paper feed rollers 39 and 40 to the area between the printing drum 26 and the pressure roller 140, synchronizing with the rotation of the printing drum 26. The paper detection sensor 42 detects whether or not the printing paper 37 is transferred to the space between the timing roller 41 and the timing roller 41. In addition, it is configured so that the rotation of the drum driving motor 25 is selectively transmitted to the paper feed rollers 39 and 40 via a paper feed clutch 43.

The paper discharge section 6 includes a separator 44 for separating the printing paper 37 from the printing drum 26, a paper transfer passage 45 where the printing paper 37 estranged from the printing drum 26 by the separator 44 is transferred, and a paper receiving tray 46 for stacking the printing paper 37 discharged through the paper transfer passage 45. In addition, an end fence 61 and a pair of side fences 59 and 60 are located on the paper receiving tray 46.

The stencil discharge section 4 includes a pair of stencil disposal rollers 47, a stencil disposal motor 48, a stencil disposal box 49, and a stencil removal sensor 50. The pair of stencil disposal rollers 47 transfer the used stencil sheet 18 discharged from the printing drum 26. The stencil disposal motor 48 drives the rotation of the pair of stencil disposal rollers 47. The stencil disposal box 49 contains the used stencil sheet 18 transferred by the pair of stencil disposal rollers 47. The stencil removal sensor 50 detects whether or not the used stencil sheet 18 is transferred into the stencil disposal box 49 by the pair of stencil disposal rollers 47.

Figure 3:
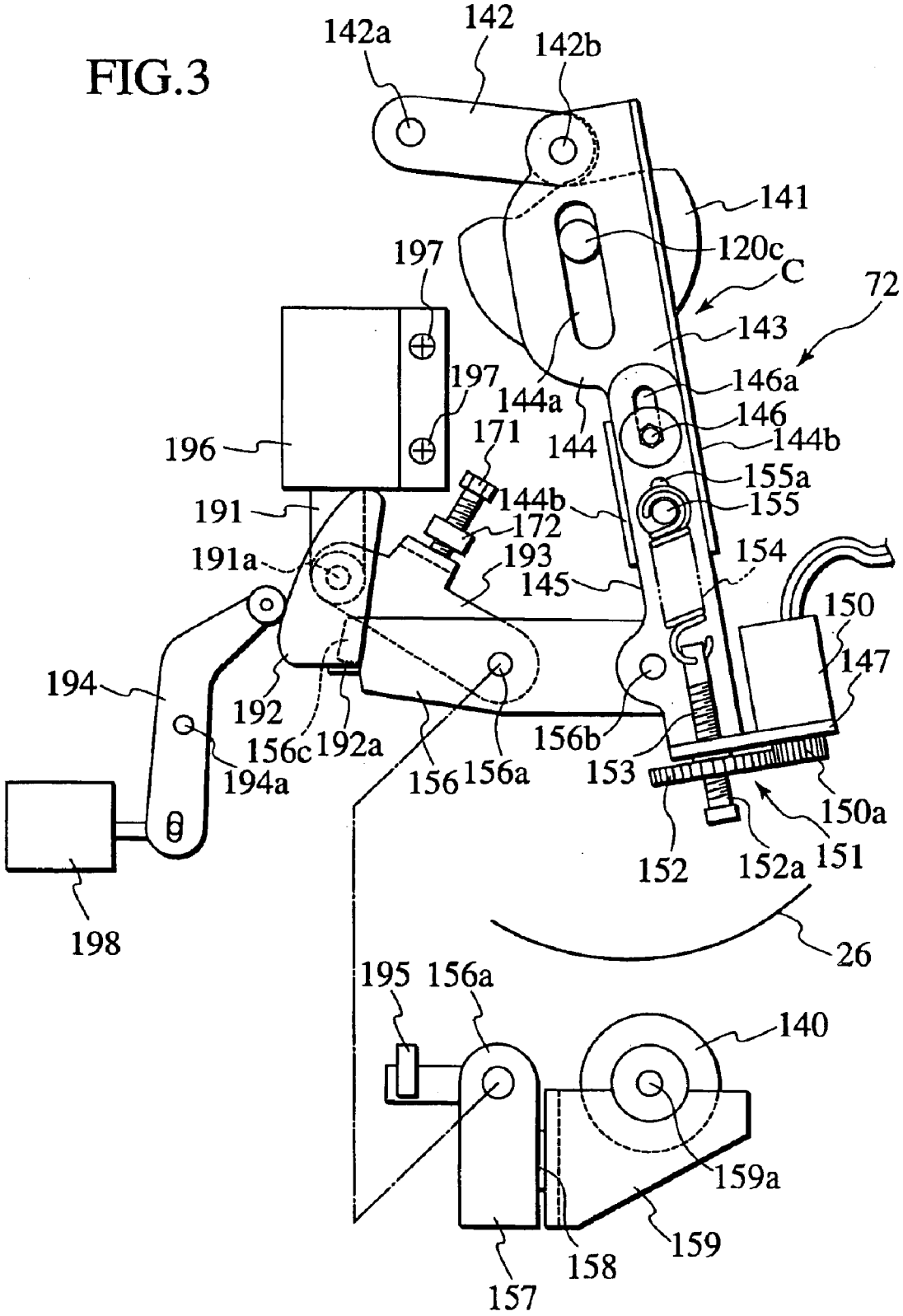
FIG. 3 is a scheme diagram showing an example of structure of a printing pressure adjustment section in the stencil printing machine shown in FIG. 1.

An example of detailed structure of the printing pressure adjustment section 72 is disclosed in FIG. 3.

As shown in FIG. 3, a main shaft 120*c* of the printing drum 26 is attached to a cam 141 which rotates with the printing drum 26 one by one. The cam 141 engages with a cam follower lever 142. One end of the cam follower lever 142 is supported by a shaft 142*a*. The cam follower lever 142 is pressed downward in FIG. 3 by a spring (not shown) and the other end of the cam follower lever 142 is connected to a lever element 143 in linkage with a shaft 142*b*.

The lever element 143 includes a first lever element 144 and a second lever element 145. The first lever element 144 is directly connected to the cam follower lever 142 by the shaft 142*b*. The second lever element 145 is provided with a pulse motor 150 and a speed-reduction mechanism 151.

The first lever element 144 is provided with a perpendicular sliding guide 144*b* to both sides in which the second lever element 145 slides. Since the second lever element 145 is guided and moved along the perpendicular sliding guide 144*b*, both of the first lever element 144 and the second lever element 145 can be extended/shrunk in the length direction of the lever element 143 each other. Since a lengthwise hole 146*a* is formed in the second lever element 145 and a stud 146 fixed to the first lever element 144 is fit in this lengthwise hole 146*a*, both of the first lever element 144 and the second lever element 145 are restricted in their amount of maximum extension and shrinkage.

Further, a lengthwise hole 144*a* is formed through the first lever element 144 to relieve the main shaft 120*c* so that the whole of the lever element 143 carried out the vertical motion according to the rotation of the cam 141.

The lower end part of the second lever element 145 is bent and formed as a supporting plate part 147. The supporting plate part 147 is provided with the pulse motor 150 and the speed-reduction mechanism 151 for reducing the output of the pulse motor 150.

A gear 150*a* is attached to the output shaft of the pulse motor 150, and is engaged with a large diameter gear 152 composing the speed-reduction mechanism 151 together with this gear 150*a*. Further, a threaded hole 152*a* engaged with a threaded control rod 153 is formed through the center of the large diameter gear 152. The rotary motion of the pulse motor 150 is decelerated by the engagement of the gear 150*a* and the large diameter gear 152, and is converted to the rectilinear motion in the axial direction of the threaded control rod 153 according to its thread engagement.

One end of a tensile coil spring 154 is hooked in one end of the threaded control rod 153, and other end of the tensile coil spring 154 is hooked on a pin 155 fixed on the first lever element 144. Therefore, the second lever element 145 is enforced to pull upward in FIG. 3 with respect to the first lever element 144.

In addition, a lengthwise hole 155*a* into which the pin 155 is inserted is formed through the second lever element 145.

One end of an oscillation lever 156 is connected to the second lever element 145 in linkage with a shaft 156*b*. The middle part of the oscillation lever 156 is supported rotatably by a shaft 156*a* of a machine frame (not shown). Further, a connecting plate 157 and one end of a connecting lever 193 are connected to the shaft 156*a* on the same axis, and a bracket 159 supporting the pressure roller 140 rotatably with using a rotary shaft 159*a* is attached on the connecting plate 157 through connecting member 158.

A damper 196 for damping the mechanical vibrations is screwed to the machine frame (not shown) with a screw 197. A plunger 191 of the damper 196 is rotatably connected to connecting lever 193. The middle part of a hook lever 192 and other end of the connecting lever 193 are attached respectively to the plunger 191 with a shaft 191*a*.

An engagement part 192*a*, which is bent into a right angle, is provided on the lower end part of the hook lever 192. Further, a protrusion 156*c*, which is detachable/attachable from/to the engagement part 192*a*, is provided on other end of the oscillation lever 156. Therefore, the oscillation lever 156 is drivingly and selectively connected to the connecting lever 193 when the oscillation lever 156 is rotated counterclockwise in FIG. 3.

In addition, a maximum amount of rotation in the clockwise direction in FIG. 3 of the connecting lever 193, in other word, a maximum separation distance of the pressure roller 140 can be set by adjusting an adjustment screw 171 engaged with a supporting part 172.

The hook lever 192 is enforced to rotate clockwise in FIG. 3 with a coil spring (not shown), that is, in the direction in which the hook lever 192 is released from the engagement to the oscillation lever 156.

A plunger lever 194 is attached rotatably on the machine frame (not shown) with a shaft 194*a*. The plunger lever 194 is driven rotatably and selectively clockwise in FIG. 3 by a press solenoid 198, and enforces the hook lever 192 to rotate counter-clockwise in FIG. 3, that is, in the direction in which the hook lever 192 is closed to the engagement to the oscillation lever 156.

Therefore, if the press solenoid 198 is turned on, the oscillation lever 156 is drivingly connected to the connecting lever 193.

A supervisory sensor 195 detects the position of the pressure roller 140.

When the cam 141 is in the position shown in FIG. 3, the whole of the lever element 143 is in the lower part position, and the pressure roller 140 is released from the printing drum 26 as shown in FIG. 3.

When the main shaft 120*c* of the printing drum 26 driven by the drum driving motor 25 is rotated by 180 degrees clockwise in FIG. 3, the cam 142 is also rotated by 180 degrees. Then, the oscillation lever 156 is rotated counter-clockwise in FIG. 3 around the shaft 156*a*.

At this time, the press solenoid 198 is pulled. If the engagement part 192*a* of the hook lever 192 is fit in the protrusion 156*c* of the oscillation lever 156, the rotation of the oscillation lever 156 is transmitted to the connecting lever 193 via the hook lever 192. Therefore, the shaft 156*a* is rotated counter-clockwise in FIG. 3 and the pressure roller 140 is moved in the direction where the pressure roller 140 presses against to the outer surface of the printing drum 26, that is, moved to the press working position. Consequently, the fed printing paper 37 is pressed against the outer surface of the printing drum 26, thereby to perform the stencil printing.

At this time, the first lever element 144 is pulled up, and this upward movement is transmitted to the second lever element 145 while providing the tensile force to the tensile coil spring 154. The oscillation lever 156 is then rotated counter-clockwise in FIG. 3 around the shaft 156*a*. When the pressure roller 140 is pressed against the outer surface of the printing drum 26 nipping the printing paper 37, the counter-clockwise (in FIG. 3) rotary movements of the oscillation lever 156 around the shaft 156*a* are limited. Therefore, since the first lever element 144 is pulled upward still more than this state, the first lever element 144 displacements against the second lever element 145, and then the tensile coil spring 154 is stretched. Consequently, the pressure roller 140 is pushed against the outer surface of the printing drum 26 nipping the printing paper 37 by the spring force by the extension of the tensile coil spring 154, and thereby the pressure force of the pressure roller 140 is determined by this spring force.

In order to adjust the pressure force, the position in the length direction of the threaded control rod 153 in the second lever element 145 is adjusted by rotating the large diameter gear 152 by the drive force of the pulse motor 150. Consequently, the attachment length of the tensile coil spring 154 is changed, and the tensile force of the tensile coil spring 154 is changed according to this attachment length.

According to the changes of the tensile force of the tensile coil spring 154, the pressure force for pressing against the outer surface of the printing drum 26 is changed under the above mentioned action.

Processing Operation of Stencil Printing Machine

Figure 6A:
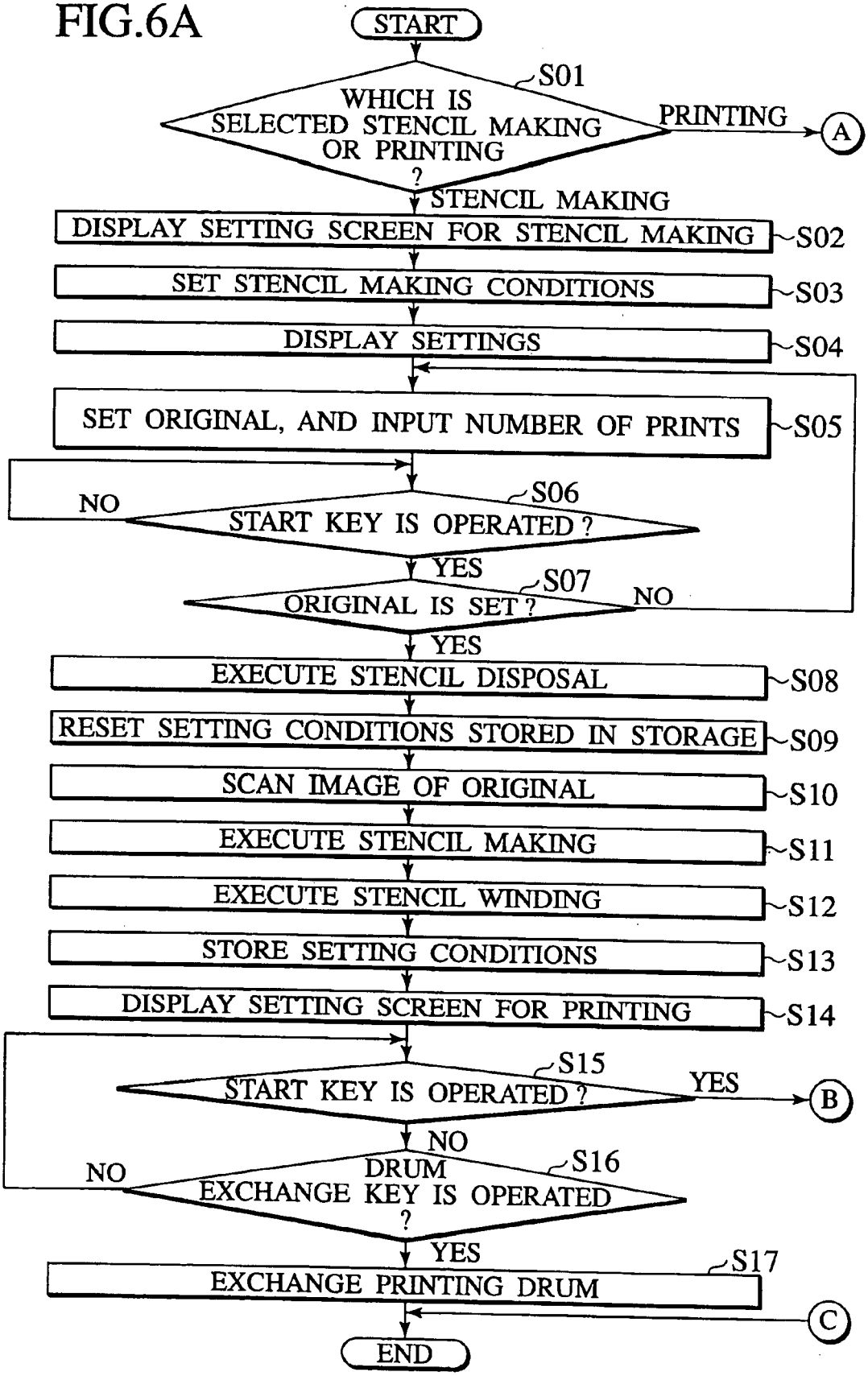
FIGS. 6A and 6B are flowcharts showing an example of stencil making processing and printing processing of the stencil printing machine shown in FIG. 1.
Figure 6B:
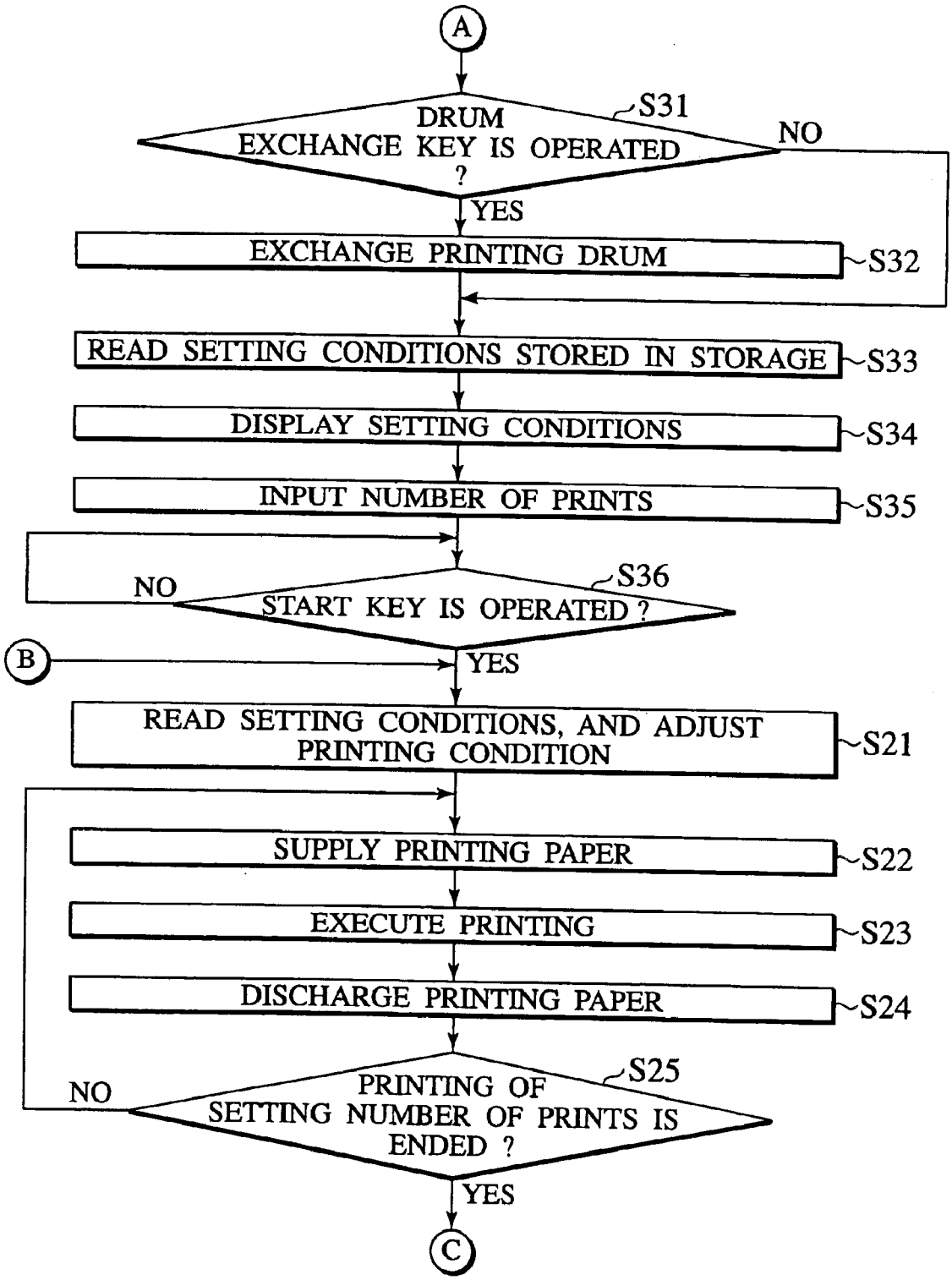

Processing operation of the stencil printing machine 100 according to the present embodiment will be described with reference to the flow charts shown in FIGS. 6A and 6B.

In addition, the processing operations to be described herein below are implemented through the control to all sections of the stencil printing machine 100 by the control section 9.

In Step S01, the control section 9 discriminates which was selected between the stencil making and printing by the user. As a result of the discrimination, if the stencil making is selected, this processing goes to Step S02. On the other hand, if the printing is selected, this processing goes to Step S31.

In Step S02, the control section 9 controls the liquid crystal touch panel 85 to display the stencil making setting screen including "original" (type of the original), "magnification", "printing mode", "paper size", and the like. (The example is shown in FIG. 4.)

In Step S03, the user inputs the stencil making conditions, such as "original" (type of the original), "magnification", "printing mode", "paper size", or the like, into the stencil making setting screen displayed on the liquid crystal touch panel 85.

In Step S04, the control section 9 controls the control panel 8 to display the stencil making conditions inputted by the user. In addition, about the printing density and the printing speed, the control section 9 reads out the standard setting value according to the printing mode from the ROM or the like of the control section 9, and displays on the control panel 8. Further, the control section 9 stores the printing conditions (the standard setting value) in the RAM or the like of the control section 9.

If the standard setting value is updated via the printing density setting keys 87*a*, 87*b* or the printing speed setting keys 89*a*, 89*b*, the control section 9 updates the setting value displayed on the control panel 8 and updates the printing conditions stored in the RAM.

In Step S05, the user sets an original on the original set tray 10, and inputs the number of prints with the ten-keypad 81. The control section 9 controls the display section 84 to display the inputted number of the prints.

In Step S06, the control section 9 discriminates whether the start key 82 was operated or not. As a result of the discrimination, when the start key 82 is operated, this processing goes to Step S07. On the other hand, when the start key 82 is not operated, the control section 9 waits for the start key 82 to be operated.

In Step S07, the control section 9 discriminates whether or not the original is set on the original set tray 10. As a result of the discrimination, if the original is set on the original set tray 10, this processing goes to Step S08. On the other hand, if the original is not set on the original set tray 10, this processing returns to Step S05.

In Step S08, the stencil discharge section 4 removes the used stencil sheet 18 wrapped around the printing drum 26 to be used, and discharges the used stencil sheet 18 into the stencil disposal box 49.

In Step S09, the control section 9 resets the printing mode and the printing conditions stored in the storage section 71 of the printing drum 26 corresponding to the discharged stencil sheet 18, and this processing goes to Step S10.

In Step S10, the original scanning section 1 scans an image of the original set on the original set tray 10, and sends the scanned image data to the stencil making section 2.

In Step S11, the stencil making section 2 perforates the stencil sheet 18 in order to form the image data, sent from the original scanning section 1, according to the printing mode stored in the RAM of the control section 9. For example, if the printing mode is set as "ink-saving", the stencil making section 2 reduces the number of perforating of the stencil sheet 18 by a predetermined method.

In Step S12, the stencil winding section 3 wraps the perforated stencil sheet 18 transferred from the stencil making section 2 around the printing drum 26.

In Step S13, the control section 9 stores the printing mode and the printing conditions, read from the RAM of the control section 9, in the storage section 71 of the printing drum 26 wrapped around at Step S12. In other words, the printing mode and the printing conditions corresponding to the perforated stencil sheet 18 are stored in the storage section 71 of the printing drum 26.

In Step S14, after the stencil making processing is completed, the control section 9 controls the liquid crystal touch panel 85 to display the printing setting screen. (The example is shown in FIG. 5.)

In Step S15, the control section 9 sets the printing conditions inputted by the user via the printing setting screen, and discriminates whether or not the user operated the start key 82. As a result of the discrimination, when the start key 82 is operated, this processing goes to Step S21. On the other hand, when the start key 82 is not operated, this processing goes to Step S16.

In Step S16, the control section 9 discriminates whether or not the user operated a "DRUM EXCHANGE" button displayed on the liquid crystal touch panel 85. As a result of the discrimination, when the "DRUM EXCHANGE" button is operated, the control section 9 releases a lock (not shown) of the printing drum 26, and this processing goes to Step S17. On the other hand, when the "DRUM EXCHANGE" button is not operated, this processing returns to Step S15.

In Step S17, the control section 9 ends this processing after the user exchanges the printing drum 26.

On the other hand, as the result of the discrimination in Step S15, when the start key 82 is operated, in Step S21, the control section 9 reads the conversion value of the printing pressure adjustment section 72 and the printing speed adjustment section 73, previously stored in the ROM of the control section 9, corresponding to the printing mode and the printing conditions stored in the RAM of the control section 9. The control section 9 then controls the printing pressure adjustment section 72 and the printing speed adjustment section 73 for adjusting the pressure force of the pressure roller 140 and the number of the revolutions of the printing drum 26, based on the read conversion value.

In Step S22, the paper supply section 5 feeds one sheet of the printing paper 37 to the printing section 7.

In Step S23, the printing section 7 transfers the fed printing paper 37 so as pressing the printing paper 37 with the pressure roller 140 against perforated the stencil sheet 18 wrapped around the printing drum 26, in order to transfers the ink 34 to the fed printing paper 37.

In Step S24, the paper discharge section 6 discharges the printing paper 37 to the paper receiving tray 46.

In Step S25, the control section 9 discriminates whether or not the printing processing of the number of the prints set up by the user ended. As a result of the discrimination, when the printing processing is not ended, this processing returns to Step S22. On the other hand, when all of the printing processing is ended, the control section 9 ends this processing.

On the other hand, as the result of discrimination in Step S01, when the printing is selected, in Step S31, the control section 9 discriminates whether or not the user operated a "DRUM EXCHANGE" button displayed on the liquid crystal touch panel 85. As a result of the discrimination, when the "DRUM EXCHANGE" button is operated, the control section 9 releases a lock (not shown) of the printing drum 26, and this processing goes to Step S32. On the other hand, when the "DRUM EXCHANGE" button is not operated, this processing goes to Step S33.

In Step S32, the user exchanges the printing drum 26.

In Step S33, the control section 9 reads the printing mode and the printing conditions stored in the storage section 71 of the exchanged printing drum 26, and stores them in the RAM of the control section 9.

In Step S34, the control section 9 controls the liquid crystal touch panel 85, the printing density display section 86 and the printing speed display section 88 to display the printing mode and the printing conditions stored in the RAM.

In Step S35, the user inputs the number of prints with the ten-keypad 81. The control section 9 controls the display section 84 to display the inputted number of the prints.

In Step S36, the control section 9 discriminates whether or not the user operated the start key 82. As a result of the discrimination, when the start key 82 is operated, this processing goes to Step S21 in order to execute the following processing sequentially. On the other hand, when the start key 82 is not operated, the control section 9 waits for the start key 82 to be operated.

That is, it is possible to print on the same conditions according to the printing mode and the printing conditions corresponding to the perforated stencil sheet 18 wrapped around the printing drum 26 to be used for the printing processing.

As is evident from above explanation, according to the stencil printing machine 100 of the present embodiment, the printing mode and the printing conditions set up in Step S03 are stored in the storage section 71 installed in the printing drum 26. When the start of printing processing is directed, it is possible to adjust the printing condition adjustment section 75 corresponding to the printing mode and the printing conditions stored in the storage section 71.

Therefore, even if the stencil making processing and the printing processing are performed separately, it is possible to print based on the printing mode and the printing conditions stored in the storage section 71 of the printing drum 26 to be used for the printing processing.

Further, it also is possible to display the printing mode and the printing conditions stored in the storage section 71 of the printing drum 26 on the display sections (the liquid crystal touch panel 85, the printing density display section 86 and the printing speed display section 88) at the time when the printing drum 26 to be used for the printing processing is set on the stencil printing machine 100, and it also is possible to print by adjusting the printing conditions adjustment section 75 to print based on the printing mode and the printing conditions stored in the storage section 71 in response to the direction of the printing processing start.

Therefore, even if two or more printing drums 26 are exchanged one after another for the multi-color printing, it is possible to print based on the printing mode and the printing conditions stored in the storage section 71 of the printing drum 26 to be used for the printing processing.

For this reason, it is possible to print based on the printing mode and the printing conditions stored in the storage section 71 of the printing drum 26 to be used for printing processing, without the requirement for the user to remember the printing mode and the printing conditions corresponding to the perforated stencil sheet 18 wrapped around the printing drum 26 to be used for the printing processing and without the requirement to adjust the printing conditions whenever the printing processing is performed. Therefore, the printed matter for which the user desires can be obtained easily, and the working efficiency of the printing processing also improves.

Furthermore, the stencil printing machine 100 includes the display sections (the liquid crystal touch panel 85, the printing density display section 86 and the printing speed display section 88), and displays not only the printing mode and the printing conditions inputted via the control panel 8 but also the printing mode and the printing conditions stored in the storage section 71 of the printing drum 26 to be used for the printing processing. Therefore, even if the stencil making processing and the printing processing are performed separately, or even if two or more printing drums 26 are exchanged one after another for the multi-color printing, the user is able to recognize the printing conditions corresponding to the perforated stencil sheet 18 wrapped around the printing drum 26 to be used for the printing processing.

As explained above, according to the present invention, even if the stencil making processing and the printing processing are performed separately, or even if two or more printing drums are exchanged one after another for the multi-color printing, it is possible to provide the stencil printing machine and the method for the stencil printing machine, which performs stencil making and printing according to the printing mode and the printing conditions corresponding to the perforated stencil sheet wrapped around the printing drum to be used for the printing processing.

Although the embodiments of the present invention have been described in detail, the present invention may be embodied in other specific forms without departing from the spirit or essential characteristics thereof.

In the present embodiment, for example, although the stencil printing machine 100 which scans the original in the original scanning section 1 and then performs the stencil making/printing processing is explained above, it is applicable similarly to a stencil printing system which connects with other apparatus, receives the original data over a network etc. via the external interface section 74, and performs stencil making/printing processing.

The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

This application claims benefit of priority under 35 USC §119 to Japanese Patent Application No. 2003-032365 filed on Feb. 10, 2003, the entire contents of which are incorporated by reference herein.

What is claimed is:

1. A machine for stencil printing comprising:

a control panel for setting stencil making conditions and printing conditions;

a stencil making section making a stencil sheet based on the stencil making conditions;

a stencil winding section wrapping the stencil sheet around a printing drum, the printing drum comprising a storage section;

a printing section including a printing conditions adjustment section, the printing conditions adjustment section adjusting the printing section based on the printing conditions; and a control section storing the stencil making conditions of the stencil sheet and the printing conditions into the storage section at the time when the stencil sheet is wrapped around the printing drum, the control section adjusting the printing conditions adjustment section to print based on the stencil making conditions and the printing conditions in response to a direction of start of printing processing.

2. The machine of claim 1, further comprising a display section for displaying the stencil making conditions and the printing conditions.

3. The machine of claim 2, wherein the control section controls the display section to display the stencil making conditions and the printing conditions at the time when the printing drum to be used for the printing processing is set on the machine, and adjusts the printing conditions adjustment section to print based on the stencil making conditions and the printing conditions stored in the storage section in response to the direction of the printing processing start.

4. The machine of claim 1, wherein the stencil making conditions includes an ink-saving printing in order to printing with cutting back ink consumption.

5. The machine of claim 1, wherein the printing conditions adjustment section includes a printing speed adjustment section for adjusting printing speed.

6. The machine of claim 5, wherein the printing speed adjustment section adjusts the printing speed as a number of revolutions of the printing drum.

7. The machine of claim 1, wherein the printing conditions adjustment section includes a printing pressure adjustment section for adjusting printing density.

8. The machine of claim 7, wherein the printing pressure adjustment section adjusts the printing density as a pressure force of a pressure roller against the printing drum.

9. A method for stencil printing of a stencil printing machine, the stencil printing machine includes a control panel for setting stencil making conditions and printing conditions, a stencil making section making a stencil sheet based on the stencil making conditions, a stencil winding section wrapping the stencil sheet around a printing drum, a printing section having a printing condition adjustment section adjusting the printing section based on the printing conditions, the method comprising:

storing the stencil making conditions of the stencil sheet and the printing conditions into a storage section installed in the printing drum at the time when the stencil sheet is wrapped around the printing drum; and adjusting the printing condition adjustment section to print based on the stencil making conditions and the printing conditions in response to a direction of start of printing processing.

10. The method of claim 9, wherein the stencil printing machine displays the stencil making conditions and the printing conditions on a display section at the time when the printing drum to be used for the printing processing is set on the stencil printing machine, and adjusts the printing condition adjustment section to print based on the stencil making conditions and the printing conditions stored in the storage section in response to the direction of the printing processing start.

* * * * *

UNITED STATES PATENT AND TRADEMARK OFFICE

CERTIFICATE OF CORRECTION

PATENT NO. : 6,899,024 B2
DATED : May 31, 2005
INVENTOR(S) : Watanabe et al.

It is certified that error appears in the above-identified patent and that said Letters Patent is hereby corrected as shown below:

Column 14,
Lines 25-26, please delete second occurance of "printing" and replace with -- print --

Signed and Sealed this

Nineteenth Day of July, 2005

JON W. DUDAS
*Director of the United States Patent and Trademark Office*